US005571651A

United States Patent [19]

Inaba et al.

[11] Patent Number: 5,571,651

[45] Date of Patent: Nov. 5, 1996

[54] CAPSULE TONER

[75] Inventors: Yoshihiro Inaba; Tsutomu Kubo; Koichi Takashima, all of Kanagawa, Japan

[73] Assignee: Fuji Xerox Co., Ltd., Tokyo, Japan

[21] Appl. No.: 223,131

[22] Filed: Apr. 5, 1994

Related U.S. Application Data

[63] Continuation of Ser. No. 769,251, Oct. 1, 1994, abandoned.

[30] Foreign Application Priority Data

Oct. 4, 1990 [JP] Japan ..... 2-265174

[51] Int. Cl.[6] ..... G03G 9/00

[52] U.S. Cl. ..... 430/109; 430/110; 430/108; 430/138

[58] Field of Search ..... 430/109, 110, 430/108, 138

[56] References Cited

U.S. PATENT DOCUMENTS

| | | | |
|---|---|---|---|
| 4,661,439 | 4/1987 | Ruskin | 430/449 |
| 4,761,358 | 8/1988 | Hosoi et al. | 430/109 |
| 4,837,394 | 6/1989 | Alexandrovich et al. | 430/110 |
| 4,859,560 | 8/1989 | Nakamura et al. | 430/137 |
| 4,904,562 | 2/1990 | Yusa et al. | 430/138 |
| 5,126,225 | 6/1992 | Wilson et al. | 430/108 |

FOREIGN PATENT DOCUMENTS

| | | |
|---|---|---|
| 59-187352 | 10/1984 | Japan . |
| 59-187357 | 10/1984 | Japan . |
| 63-15258 | 7/1986 | Japan . |

OTHER PUBLICATIONS

English Abstract of Japanese Document No. 57–179860 dated Nov. 5, 1982.

English Abstract of Japanese Document No. 58–66948 dated Apr. 21, 1983.

English Abstract of Japanese Document No. 58–145964 dated Aug. 31, 1983.

English Abstract of Japanese Document No. 59–148066 dated Aug. 24, 1984.

English Abstract of Japanese Document No. 59–162562 dated Sep. 13, 1984.

English Abstract of Japanese Document No. 59–185353 dated Oct. 20, 1984.

English Abstract of Japanese Document No. 59–187357 dated Oct. 24, 1984.

English Abstract of Japanese Document No. 63–163373 dated Jul. 6, 1988.

*Primary Examiner*—George F. Lesmes
*Assistant Examiner*—Laura Weiner
*Attorney, Agent, or Firm*—Finnegan, Henderson, Farabow, Garrett & Dunner, L.L.P.

[57] ABSTRACT

A novel capsule toner is provided, comprising a core and a shell covering the core, wherein the shell is made of a substance capable of producing radical and there is attached to the surface of said shell a polymer comprising as monomer component a quaternary ammonium salt-containing vinyl monomer represented by formula (I):

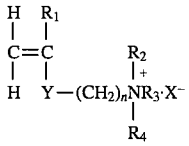

(I)

wherein $R_1$ represents a hydrogen atom or methyl group; $R_2$, $R_3$ and $R_4$ each represents a hydrogen atom, a $C_{1-5}$ alkyl group or a benzyl group; Y represents —$CO_2$— or —CONH—; n represents an integer 1 to 7; and $X^-$ represents an anion containing $-COO^-$ group, —$SO_3^-$ group or —$SO_4^-$ group in the structure.

3 Claims, No Drawings

CAPSULE TONER

This application is a continuation of application Ser. No. 07/769,251, filed Oct. 1, 1991, now abandoned.

FIELD OF THE INVENTION

The present invention relates to a capsule toner for electrophotography.

BACKGROUND OF THE INVENTION

As one of electrophotographic toners for development of electrostatic latent images formed on the surface of electrophotographic photoreceptor, electrostatic recording material, etc. there has been heretofore known a microcapsule toner formed of a core and a shell. Various types of such a microcapsule toner have been proposed. For example, JP-A-59-185353 and 59-187357 (the term "JP-A" as used herein means an "unexamined published Japanese patent application") dislcose a capsule toner comprising a specific quaternary ammonium salt polymer present on the shell thereof.

However, since the polymer as described in the above cited patent applications contains halogen atoms as anions in the quaternary ammonium salt structure, it has a disadvantage that it shows a poor environmental stability, particularly humidity stability, of charging. Further, since the polymer is incorporated in the shell as one of the constituents of the shell of the capsule, it is difficult to allow only one constituent to satisfy both the desired mechanical strength and chargeability of the toner, so that selection of materials is limited.

SUMMARY OF THE INVENTION

It is therefore an object of the present invention to provide a capsule toner which exhibits a high mechanical strength and an excellent charging property.

The above object of the present invention is accomplished with a capsule toner comprising a core and a shell covering said core wherein said shell comprises a substance capable of producing a radical, and there is attached to the surface of said shell a polymer comprising as a monomer component a quaternary ammonium salt-containing a vinyl monomer represented by formula (I):

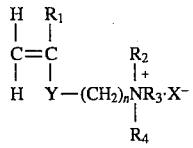

(I)

wherein $R_1$ represents a hydrogen atom or methyl group; $R_2$, $R_3$ and $R_4$ each represents a hydrogen atom, a $C_{1-5}$ alkyl group or a benzyl group; Y represents —$CO_2$— or —CONH—; n represents an integer 1 to 7; and $X^-$ represents an anion containing a —$COO^-$ group, a —$SO_3^-$ group or a —$SO_4^-$ group in the structure.

DETAILED DESCRIPTION OF THE INVENTION

The capsule toner of the present invention has a so-called capsule structure comprising a core and a shell covering the core. The shell is formed of a substance capable of producing a radical.

The term "substance capable of producing a radical" as used herein means a "substance which undergoes a hydrogen abstraction reaction or addition reaction with a monomer radical or serium (IV) ion to produce a radical". Specific examples of such substance include polymers such as polyamide, polyurea, polyurethane, polyester, polyvinyl acetate, polyvinyl alcohol, cellulose, synthetic rubber, styrene-acrylate or -methacrylate (hereafter collectively referred to as "(meth)acrylate") copolymer, epoxy resin, phenoxy resin and acrylic resin, and mixtures thereof. In the present invention, as a resin to be incorporated in the shell there may be preferably be used polyurea resin, polyurethane resin, polyamide resin, polyester resin, epoxy resin, epoxyurea resin or epoxyurethane resin. Particularly preferred are polyurea resin and polyurethane resin, singly or in admixture, or epoxyurea resin and epoxyurethane resin, singly or in admixture.

In the present invention, the polymer containing as monomer a component a vinyl monomer represented by formula (I) may be physically or chemically attached to the surface of the shell. For example, the polymer may be physically attached to the shell surface by application of heat or pressure, or by dissolving the polymer in an appropriate solvent and spray-drying the solution together with the capsule toner particles. The polymer may also be attached to the shell surface through chemical bonds by way of graft polymerization with the shell substance. The amount of the polymer to be attached is generally from 0.1 to 50% by weight, preferably from 0.5 to 10% by weight, based on the weight of the capsule toner particle (not including the weight of the attached polymer).

Specific examples of the cation portion in the vinyl monomer represented by formula (I) include those represented by the following structural formulae:

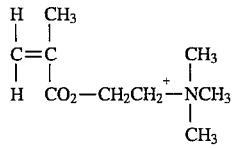

(1)

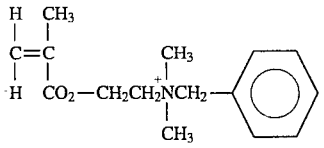

(2)

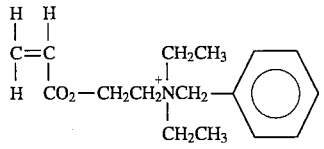

(3)

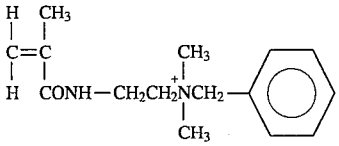

(4)

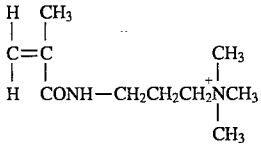

(5)

The anion $X^-$ in the vinyl monomer is preferably represented by the formula Z—$CO_2^-$, Z—$SO_3^-$ or Z—$SO_4^-$, wherein Z is a substituted or unsubstituted alkyl, aryl or aralkyl group. Specific examples thereof include an aliphatic carboxylic acid group preferably having 2 to 12 carbon atoms such as $CH_3CO_2^-$, $CH_3CH_2CO_2^-$, $CH_3CH_2CH_2CO_2^-$, $CH_3(CH_2)_6CO_2^-$ and $CH_3(CH_2)_{10}CO_2^-$, an aromatic carboxylic acid group preferably having 7 to 12 cabon atoms such as

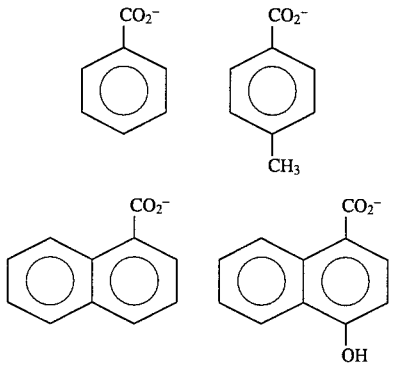

an aromatic sulfonic acid group preferably having 6 to 18 carbon atoms such as

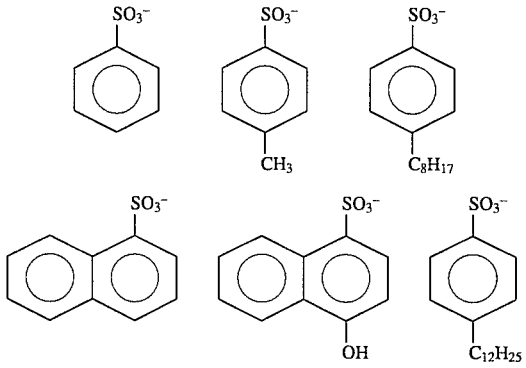

and an alkali salt of sulfate preferably having 6 to 18 atoms such as sodium laurylsulfate and sodium stearylsulfate. The anion $X^-$ may also be an anion residue of an acidic dye such as acid red, acid orange, acid violet and acid blue.

In the present invention, the polymer containing as a monomer component a monomer represented by formula (I) may be a copolymer containing the monomer as one of monomer components. The content of the monomer to be contained as one component of the copolymer is in the range of 1 to 80 mol %, preferably 5 to 60 mol % based on the total amount of monomers constituting the polymer. Examples of the monomer to be copolymerized with the monomer represented by formula (I) include (meth)acrylic acid, (meth-)acrylates such as methyl (meth)acrylate, ethyl (meth)acrylate, propyl (meth)acrylate, butyl (meth)acrylate, pentyl (meth)acrylate, hexyl (meth)acrylate, lauryl (meth)acrylate, cyclohexyl (meth)acrylate, 2-ethylhexyl (meth)acrylate, benzyl (meth)acrylate, hydroxyethyl (meth)acrylate, hydroxypropyl (meth)acrylate, 2-ethoxyethyl (meth)acrylate, glycidyl (meth)acrylate and phenyl (meth)acrylate, aliphatic vinylesters such as vinyl formate, vinyl acetate, vinyl propionate, vinyl butyrate, vinyl trimethylacetate, vinyl caproate, vinyl caprate and vinyl stearate, vinylethers such as ethyl vinyl ether, propyl vinyl ether, butyl vinyl ether, hexyl vinyl ether, 2-ethylhexyl vinyl ether and phenyl vinyl ether, vinyl ketones such as methyl vinyl ketone and phenyl vinyl ketone, and vinyl aromatic compounds such as styrene, chlorostyrene, hydroxystyrene and α-methylstyrene. One or more of these monomers in admixture can be copolymerized with the monomer represented by formula (I). Of these, (meth)acrylates are particularly preferred.

In the present invention, a monomer of formula (I) which already contains the anion portion $X^-$ may be polymerized on the surface of the shell to provide the polymer of the present invention. Alternatively, the polymer of the present invention may be provided by a process which comprises polymerizing a corresponding halogenated ammonium salt monomer of the monomer of formula (I) on the surface of the shell to form a halogen ion-containing polymer, and then converting the halogen ion to the above mentioned anion by ion exchange. The latter process is particularly preferred as the selection of anion seeds can be made with fewer limitations and the time required for synthesis of monomers can be minimized.

The ion exchange treatment carried out in the preferred process is a treatment for partly or entirely replacing the anion portion of the polymer attached on the shell surface with a desired anion. For example, the treatment can be carried out by dissolving a sodium or potassium salt of the desired anion in deionized water and adding the polymer-attached toner particles to the solution or vice versa. The thus treated toner particles are washed with water.

The core of capsule toner of the present invention will be further described hereinafter. The core mainly comprises a pressure-fixable component or a heat-fixable component if it is used for the purpose of fixing under pressure or under heat, respectively. In particular, if fixing under pressure is desired, the core preferably one mainly comprising a binder resin, a high boiling solvent capable of dissolving the binder resin and a coloring material or one mainly comprising a soft solid substance and a coloring material. If necessary, the coloring material may be replaced by a magnetic powder, or an additive such as silicone oil may be added to the core for the purpose of improving fixability. Further, a high boiling solvent incapable of dissolving the binder resin may be added to the high boiling solvent capable of dissolving the binder resin. The type and percentage composition of the constituents of the core are preferably altered depending on the fixing mode i.e., pressure-fixation on heat-fixation.

Any known fixing resin can be used as a binder resin. Specific examples of resins include acrylic ester polymers such as polymethyl acrylate, polyethyl acrylate, polybutyl acrylate, poly-2-ethylhexyl acrylate and polylauryl acrylate, methacrylic ester polymers such as polymethyl methacrylate, polybutyl methacrylate, polyhexyl methacrylate, poly-2-ethylhexyl methacrylate and polylauryl methacrylate, copolymers of styrene monomer and acrylic ester or methacrylic ester, ethylenic polymers and copolymers thereof such as polyvinyl acetate, polyvinyl propionate, polyvinyl butyrate and polypropyrene, styrenic copolymers such as styrene-butadiene copolymer and styrene-maleic acid copolymer, polyvinyl ether, polyvinyl ketone, polyester, polyamide, polyurethane, rubber, epoxy resin, polyvinyl butyral, rosin, modified rosin, terpene resin, and phenol resin. These binder resins may be used singly or in admixture. The binder resin may be incorporated in the reaction system in the form of a monomer which is polymerized to form a binder resin after completion of encapsulation.

As high boiling solvent capable of dissolving such a binder resin there can be used an oily solvent having a boiling point of 140° C. or higher, preferably 160° C. or higher. Such a high boiling solvent can be selected from those described as plasticizers in "Modern Plastics Encyclopedia" (1975–1976). Those disclosed as core components for pressure-fixed capsule toner in JP-A-58-145964 and 63-163373 may also be used. Specific examples of high boiling solvents include phthalic acid esters (e.g., diethyl phthalate, dibutyl phthalate), aliphatic dicarboxylic esters (e.g., diethyl malonate, dimethyl oxalate), phosphoric esters (e.g., tricresyl phosphate, trixylyl phosphate), citric acid esters (e.g., o-acetyltriethyl citrate), benzoic acid esters (e.g., butyl benzoate, hexyl benzoate), aliphatic acid esters (e.g., hexadecyl myristate, dioctyl azipate), alkyl naphthalenes (e.g., methyl naphthalene, dimethyl naphthalene, monoisopropyl naphthalene, diisopropyl naphthalene), alkyldiphenyl ethers (e.g., o-, m-, or p-methyldiphenyl ether), higher aliphatic or aromatic sulfonic acid amide compounds (e.g., N,N-dimethyllauroamide, N-butylbenzene sulfonamide), trimellitic acid esters (e.g., trioctyl trimellitate), diarylalkanes (e.g., diarylmethane such as dimethylphenylphenylmethane, diarylethane such as 1-phenyl-1-methylphenylethane, 1-dimethylphenyl-1-phenylethane and 1-ethylphenyl-1-phenylethane), and chlorinated paraffins. If a long chain alkyl-containing polymer such as lauryl methacrylate homopolymer or copolymer is used as binder polymer, an aliphatic saturated hydrocarbon or an organic solvent comprising as a main component an aliphatic saturated hydrocarbon (e.g., Isopar-G, Isopar-H and Isopar-L available from Exxon Chemical) may be used.

Examples of coloring material include inorganic pigment such as carbon black, red oxide, Prussian blue and titanium oxide, azo pigment such as fast yellow, disazo yellow, pyrazolone red, chelate red, brillant carmine and parabrown, phthalocyanine such as copper phthalocyanine and metal-free phthalocyanine, and condensed polycyclic pigment such as flavanthrone yellow, dibromoanthrone orange, perylene red, quinacridone red and dioxazine violet. A disperse dye, oil-soluble dye or the like may be used. Further, the black coloring material may also be entirely or partly replaced by a magnetic powder to form a magnetic one-component toner. As a magnetic powder there can be used powder of magnetite, ferrite, a metal such as cobalt, iron and nickel or alloy thereof. A magnetic powder which has been surface-treated with a coupling agent such as a silane coupling agent and a titanate coupling agent or an oil-soluble surface active agent or covered by an acrylic resin, styrene resin or epoxy resin may also be used.

As soft solid substance there can be used any flexible and fixable substance regardless of its kind. A polymer having a glass transition temperature (Tg) of −60° C. to 5° C. or a mixture thereof with other polymers is preferred.

In the preparation of capsule toner of the present invention, the encapsulation process is not specifically limited. In view of safety of coating and mechanical strength of the shell, the preparation of a capsule by interfacial polymerization can be accomplished by any known method as described in JP-A-57-179860, 58-66948, 59-148066 and 59-162562.

The thickness of the shell may be preferably altered depending on whether fixing under pressure or heating is desired. The type and percent composition of the constituents may be altered. The incorporation of a polymer such as a binder resin in capsules as one of core constituents can be accomplished by a process which comprises charging the material into the reaction system in the form of polymer with other core constituents, low boiling solvent and shell constituents so that interfacial polymerization is effected to form a shell, and, after completion of the shell formation, expelling the low boiling solvent from the system to form a core. Alternatively, another process may be employed which comprises charging core substituents in the system in the form of a monomer and effecting interfacial polymerization to form a shell, and then allowing the monomer to be polymerized to form a core.

In order to render the capsule toner fluidic or chargeable, external additives such as silicon oxide, aluminum oxide, titanium oxide and carbon black may be added to the capsule toner. The addition of such additives can be accomplished by a process which comprises drying a capsule toner, and then allowing such additives to be attached to the surface of the toner by means of a mixer such as V-shaped blender and Henschel mixer or a process which comprises dispersing such additives in water or an aqueous liquid such as a mixture of water and alcohol, adding the dispersion to a slurry of capsule toner, and then drying the material so that the additives are attached to the surface of the toner.

The present invention will be further described in the following examples, but the present invention should not be construed as being limited thereto.

EXAMPLE 1

Preparation of Capsulized Particles 30 g of a polyisobutyl methacrylate (molecular weight: $16\times10^4$) and 40 g of a styrene-n-butyl methacrylate copolymer (molecular weight: $6\times10^4$) were dissolved in a mixture of 60 g of dibutyl naphthalene and 60 g of ethyl acetate. 120 g of a magnetic powder (EPT-1000 available from Toda Kogyo K.K.) was then added to the solution. The material was subjected to dispersion in a ball mill for 16 hours. 200 g of the dispersion was then thoroughly mixed with 30 g of isocyanate (Sumidur L available from Sumitomo Bayer Urethane K.K.) and 24 g of ethyl acetate to prepare Solution A. On the other hand, 10 g of hydroxypropylmethyl cellulose (Metolose 65SH50 available from Shin-Etsu Chemical Industry Co., Ltd.) was dissolved in 200 g of ion-exhanged water. The solution was cooled to a temperature of 5° C. to prepare Solution B. Solution A was gradually added into Solution B with stirring in an emulsifier (automatic homomixer available from Tokushuki Kako K.K.) to effect emulsification. Thus, an oil-in-water type emulsion comprising oil drops with an average particle diameter of about 12 μm was obtained. The emulsion was stirred at 400 rpm by an agitator (Three-One Motor available from Shinto Kagaku K.K.) equipped with propeller blades instead of emulsifier. After 10 minutes, 100 g of a 5% aqueous solution of diethylene triamine was added dropwise to the emulsion. After completion of the dropwise addition, the mixture was heated to a temperature of 60° C. where it was then allowed to undergo an encapsulation reaction for 3 hours. After completion of the reaction, the reaction product was then poured into 2 liters of deionized water. The resulting suspension was thoroughly stirred, and then allowed to stand. After the capsulized particles were precipitated, the supernatant solution was removed from the suspension. This procedure was repeated seven times to wash the capsulized particles. Thus, capsulized particles containing an oily binder were obtained. Deionized water was added to the capsulized particles to prepare a suspension with a solid content of 40%.

Preparation of Toner 125 g of deionized water was added to 125 g (corresponding to 50 g of capsulized particles) of the suspension of capsulized particles thus prepared. The suspension was then stirred at 200 rpm in an agitator equipped with propeller blades (Three-One Motor available from Shinto Kagaku K.K.). 5 g of 1N nitric acid and 4 g of a 10% aqueous solution of serium sulfate were added to the suspension. 0.5 g of ethylene glycol dimethacrylate was then added thereto and the mixture was allowed to undergo reaction at a temperature of 15° C. for 3 hours. After completion of the reaction, the reaction product was poured into 1 liter of deionized water, thoroughly stirred, and then allowed to stand. After the capsulized particles were precipitated, the supernatant solution was removed from the reaction system. This procedure was repeated twice to wash the capsulized particles. Thus, capsulized particles comprising ethylene glycol dimethacrylate graft-polymerized on the surface of the shell thereof were obtained.

The capsulized particles were again suspended in deionized water. The suspension was then stirred at 200 rpm in an agitator equipped with propeller blades (Three-One Motor available from Shinto Kagaku K.K.). 0.4 g of potassium persulfate, 0.2 g of chloride of Exemplary Compound (1), 2.0 g of methyl methacrylate, and 0.16 g of sodium hydrogensulfite were sequentially added to the resulting emulsion. The emulsion was then allowed to undergo reaction at a temperature of 25° C. for 3 hours. After completion of the reaction, the reaction product was poured into 2 liters of deionized water. The reaction product was thoroughly stirred, and then allowed to stand. After the capsulized particles were precipitated, the supernatant solution was removed from the reaction system. This procedure was repeated four times to wash the capsulized particles.

2 g of a 5% aqueous solution of sodium 1-naphthalenesulfonate was added to the suspension of capsulized particles thus prepared. The suspension was then stirred at room temperature for 30 minutes to effect the ion exchange reaction. After completion of the reaction, the capsulized particles were washed with 1 liter of deionized water five times to obtain a capsule toner of the present invention. The capsule suspension thus obtained was then poured into a stainless steel tray. The resultant was dried at a temperature of 60° C. in a dryer for 10 hours.

3 g of the capsule toner thus obtained was then mixed with 100 g of an iron powder carrier covered with a phenolic resin in an environment of a temperature of 20° C. and a humidity of 50% and measured for charging by blow-off process. The result was +23 μC/g. Similarly, the capsule toner was mixed with the iron powder carrier in an environment of a temperature of 28° C. and a humidity of 80% and measured for charging by blow-off process. The result was +20 μC/g. 1 part of a hydrophobic silica (RA-200H available from Nihon Aerogel K.K.) was added to and thoroughly mixed with 100 parts of the toner. The toner was then evaluated for image quality in a high temperature and humidity environment of 35° C. and 85% RH. As a copying machine there was used Fuji Xerox 2700 which had been modified for use with capsule toner. As a result, 20,000 sheets of stable copies free of fog were obtained.

COMPARATIVE EXAMPLE 1

A capsule toner was prepared in the same manner as in Example 1 except that an aqueous solution of sodium 1-naphthalenesulfonate was not added to the system. The capsule toner had a chlorine anion left as it was.

3 g of the capsule toner thus obtained was then mixed with 100 g of an iron powder carrier covered with a phenolic resin in an environment of a temperature of 20° C. and a humidity of 50% and measured for charging by blow-off process. The result was +20 μC/g. Similarly, the capsule toner was mixed with the iron powder carrier in an environment of a temperature of 28° C. and a humidity of 80% and measured for charging by blow-off process. The result was +4 μC/g. 1 part of a hydrophobic silica (RA-200H available from Nihon Aerogel K.K.) was added to and thoroughly mixed with 100 parts of the toner. The toner was then evaluated for image quality in a high temperature and humidity environment of 35° C. and 85% RH as in Example 1. As a result, fog occured as early as on the first sheet of copy. The 100th sheet of copy exhibited a drop in image density and hence an image quality with an extremely poor sharpness.

EXAMPLE 2

125 g of deionized water was added to 125 g (corresponding to 50 g of capsulized particles) of the suspension of capsulized particles as prepared in Example 1. The mixture was then stirred at 200 rpm in an agitator equipped with propeller blades (Three-One Motor available from Shinto Kagaku K.K.). 5 g of 1N nitric acid and 4 g of a 10% aqueous solution of serium (IV) ammonium sulfate were added to the mixture. 0.5 g of ethylene glycol dimethacrylate was then added to the mixture which was then allowed to undergo reaction at a temperature of 15° C. for 3 hours. After completion of the reaction, the reaction product was poured into 1 liter of deionized water, thoroughly stirred, and then allowed to stand. After the capsulized particles were precipitated, the supernatant solution was removed from the reaction system. This procedure was repeated twice to wash the capsulized particles. Thus, capsulized particles comprising ethylene glycol dimethacrylate graft-polymerized on the surface of the shell thereof were obtained.

The capsulized particles were again suspended in deionized water. The suspension was then stirred at 200 rpm in an agitator equipped with propeller blades (Three-One Motor available from Shinto Kagaku K.K.). 0.4 g of potassium persulfate, 0.2 g of chloride of Exemplary Compound (2), 2.0 g of methyl methacrylate, and 0.16 g of sodium hydrogensulfite were sequentially added to the emulsion. The emulsion was then allowed to undergo reaction at a temperature of 25° C. for 3 hours. After completion of the reaction, the reaction product was poured into 2 liters of deionized water. The reaction product was thoroughly stirred, and then allowed to stand. After the capsulized particles were precipitated, the supernatant solution was removed from the reaction system. This procedure was repeated four times to wash the capsulized particles.

2 g of a 5% aqueous solution of sodium acetate was added to the suspension of capsulized particles thus prepared. The suspension was then stirred at room temperature for 30 minutes to effect the ion exchange reaction. After completion of the reaction, the capsulized particles were washed with 1 liter of deionized water five times to obtain a capsule toner of the present invention. The capsule suspension thus obtained was then poured into a stainless steel tray and dried at a temperature of 60° C. in a dryer (available from Yamato Kagaku K.K.) for 10 hours.

3 g of the capsule toner thus obtained was then mixed with 100 g of an iron powder carrier covered with a phenolic resin in an environment of a temperature of 20° C. and a humidity of 50% and measured for charging by blow-off process. The result was +21 μC/g. Similarly, the capsule toner was mixed with the iron powder carrier in an environment of a temperature of 28° C. and a humidity of 80% and measured for charging by blow-off process. The result was +19 μC/g. 1 part of a hydrophobic silica (R972 available from Nihon Aerogel K.K.) was added to and thoroughly mixed with 100 parts of the toner. The toner was then evaluated for image quality in a high temperature and humidity environment of 35° C. and 85% RH. As the copying machine there was used Fuji Xerox 2700 which had been modified for use with capsule toner. As a result, 20,000 sheets of stable copies free of fog were obtained.

COMPARATIVE EXAMPLE 2

A capsule toner was prepared in the same manner as in Example 2 except that an aqueous solution of sodium acetate was not added. The capsule toner had a chlorine anion left as it was.

3 g of the capsule toner thus obtained was then mixed with 100 g of an iron powder carrier covered with a phenolic resin in an environment of a temperature of 20° C. and a humidity of 50% and measured for charging by blow-off process. The result was +14 μC/g. Similarly, the capsule toner was mixed with the iron powder carrier in an environment of a temperature of 28° C. and a humidity of 80% and measured for charging by blow-off process. The result was +4 μC/g. 1 part of a hydrophobic silica (R972 available from Nihon Aerogel K.K.) was added to and thoroughly mixed with 100 parts of the toner. The toner was then evaluated for image quality in a high temperature and humidity environment of 35° C. and 85% RH as in Example 1. As a result, fog occured as early as on the first sheet of copy. The 50th sheet of copy exhibited a drop in image density and hence an image quality with an extremely poor sharpness.

EXAMPLE 3

Preparation of Capsulized Particles 60 g of a polylauryl methacrylate (molecular weight: $5\times10^4$) and 20 g of a petroleum resin (FTR-6125 available from Mitsui Petrochemical Industries, Ltd.) were dissolved in a mixture of 40 g of a saturated hydrocarbon solvent (Isopar H available from Exxon Chemical Co.) and 60 g of ethyl acetate. 120 g of a magnetic powder which had been subjected to hydrophobic treatment with a titanium coupling agent was then added to the solution. The mixture was subjected to dispersion in a ball mill for 24 hours. 200 g of the dispersion was then mixed with 10 g of isocyanate (Sumidur L available from Sumitomo Bayer Urethane K.K.) and 5 g of toluylene diisocyanate (coronate L available from Nippon Polyurethane Co., Ltd.) to prepare Solution A'. On the other hand, 10 g of hydroxypropylmethyl cellulose (Metolose 65SH50 available from Shin-Etsu Chemical Industry Co., Ltd.) was dissolved in 250 g of ion-exhanged water. The solution was cooled to a temperature of 5° C. to prepare Solution B'. Solution A' was gradually added into Solution B' with stirring in an emulsifier (automatic homomixer available from Tokushuki Kako K.K.) to effect emulsification. Thus, an oil-in-water type emulsion comprising oil drops with an average particle diameter of about 12 μm was obtained. The emulsion was stirred at 400 rpm by an agitator (Three-One Motor available from Shinto Kagaku K.K.) equipped with propeller blades instead of emulsifier. After 10 minutes, 100 g of a 2.5% aqueous solution of diethylene triamine was added dropwise to the emulsion. After completion of the dropwise addition, the mixture was further stirred at room temperature where it was then allowed to undergo encapsulation reaction for 2 hours. The mixture was then allowed to undergo reaction at a temperature of 65° C. for 14 hours to effect polymerization of core substance. After completion of the reaction, the reaction product was then poured into 2 liters of deionized water, which was thoroughly stirred and then allowed to stand. After the capsulized particles were precipitated, the supernatant solution was removed. This procedure was repeated five times to wash the capsulized particles. Deionized water was added to the capsulized particles to prepare a suspension with a solid content of 40%.

Preparation of Toner 125 g of deionized water was added to 125 g (corresponding to 50 g of capsulized particles) of the suspension of capsulized particles thus prepared. The mixture was then stirred at 200 rpm in an agitator equipped with propeller blades (Three-One Motor available from Shinto Kagaku K.K.). 5 g of 1N nitric acid and 4 g of a 10% aqueous solution of serium sulfate were added to the mixture. 0.5 g of ethylene glycol dimethacrylate was then added to the mixture which was then allowed to undergo reaction at a temperature of 15° C. for 3 hours. After completion of the reaction, the reaction product was poured into 1 liter of deionized water, thoroughly stirred, and then allowed to stand. After the capsulized particles were precipitated, the supernatant solution was removed from the reaction system. This procedure was repeated twice to wash the capsulized particles. Thus, capsulized particles comprising ethylene glycol dimethacrylate graft-polymerized on the surface of the shell thereof were obtained.

The capsulized particles were again suspended in deionized water. The suspension was then stirred at 200 rpm in an agitator equipped with propeller blades (Three-One Motor available from Shinto Kagaku K.K.). 0.4 g of potassium persulfate, 0.2 g of chloride of Exemplary Compound (2), 2.0 g of methyl methacrylate, and 0.16 g of sodium hydrogensulfite were sequentially added to the emulsion. The emulsion was then allowed to undergo reaction at a temperature of 25° C. for 3 hours. After completion of the reaction, the reaction product was poured into 2 liters of deionized water. The reaction product was thoroughly stirred, and then allowed to stand. After the capsulized particles were precipitated, the supernatant solution was removed from the reaction system. This procedure was repeated four times to wash the capsulized particles.

2 g of a 5% aqueous solution of an acidic dye (Fast Red A available from Wako Junyaku K.K.) was added to the suspension of capsulized particles thus prepared. The suspension was then stirred at room temperature for 30 minutes to effect the ion exchange reaction. After completion of the reaction, the capsulized particles were washed with 1 liter of deionized water five times to obtain a capsule toner of the present invention. The capsule suspension thus obtained was then poured into a stainless steel tray. The material was dried at a temperature of 60° C. in a dryer for 10 hours.

3 g of the capsule toner thus obtained was then mixed with 100 g of an iron powder carrier covered with a phenolic resin in an environment of a temperature of 20° C. and a humidity of 50% and measured for charging by blow-off process. The result was +18 μC/g. Similarly, the capsule toner was mixed with the iron powder carrier in an environment of a temperature of 28° C. and a humidity of 80% and measured for charging by blow-off process. The result was +14 μC/g. 1 part of an alumina treated with a titanium coupling agent was added to and thoroughly mixed with 100 parts of the toner. The toner was then evaluated for image quality in a high temperature and humidity environment of 35 ° C. and 85% RH. As a copying machine there was used Fuji Xerox 2700 which had been modified for use with capsule toner. As a result, 20,000 sheets of stable copies free of fog were obtained.

COMPARATIVE EXAMPLE 3

A capsule toner was prepared in the same manner as in Example 3 except that an aqueous solution of an acidic dye (Fast Red A available from Wako Junyaku K.K.) was not added. The capsule toner had a chlorine anion left as it was.

3 g of the capsule toner thus obtained was then mixed with 100 g of an iron powder carrier covered with a phenolic resin in an environment of a temperature of 20° C. and a humidity of 50% and measured for charging by blow-off process. The result was +20 μC/g. Similarly, the capsule toner was mixed with the iron powder carrier in an environment of a temperature of 28° C. and a humidity of 80% and measured for charging by blow-off process. The result was +4 μC/g. 1 part of an alumina as used in Example 3 was added to and thoroughly mixed with 100 parts of the toner. The toner was then evaluated for image quality in a high temperature and humidity environment of 35° C. and 85% RH as in Example 1. As a result, fog occured as early as on the first sheet of copy. The 50th sheet of copy exhibited a drop in image density and hence an image quality with an extremely poor sharpness.

EXAMPLE 4

Preparation of Capsulized Particles 30 g of a styrene-n-butyl methacrylate (molecular weight: 20,000) was dissolved in a mixture of 160 g of a lauryl methacrylate monomer and 30 g of ethyl acetate. 20 g of a red pigment (Phostaperm Scarlet G0 available from Bayer) was added to the mixture. The mixture was subjected to dispersion in a ball mill for 24 hours. 200 g of the dispersion was then mixed with 10 g of isocyanate (Sumidur L available from Sumitomo Vier Urethane K.K.), 4 g of toluylene diisocyanate (Coronate L available from Nippon Polyurethane Co., Ltd.), 4 g of an epoxy resin (EpiCoat 812 available from Yuka Shell Epoxy K.K.) and 3 g of azobisisobutyronitrile to prepare Solution A". On the other hand, 10 g of hydroxypropylmethyl cellulose (Metolose 65SH50 available from Shin-Etsu Chemical Industry Co., Ltd.) was dissolved in 250 g of ion-exhanged water. The solution was cooled to a temperature of 5° C. to prepare Solution B". Solution A" was gradually added into Solution B" with stirring in an emulsifier (automatic homomixer available from Tokushuki Kako K.K.) to effect emulsification. Thus, an oil-in-water type emulsion comprising oil drops with an average particle diameter of about 12 μm was obtained. The emulsion was stirred at 400 rpm by an agitator (Three-One Motor available from Shinto Kagaku K.K.) equipped with propeller blades instead of emulsifier. After 10 minutes, 100 g of a 2.5% aqueous solution of diethylene triamine was added dropwise to the emulsion. After completion of the dropwise addition, the mixture was heated to a temperature of 65° C. where it was then allowed to undergo encapsulation reaction for 2 hours. The mixture was then allowed to undergo reaction at a temperature of 65° C. for 18 hours to effect polymerization of core substance. After completion of the reaction, the reaction product was then poured into about 1 liter of deionized water. The resultant was thoroughly stirred, and then subjected to centrifugal separation. After the capsulized particles were separated, the supernatant solution was removed. This procedure was repeated five times. The product was further washed with methanol. Thus, red capsulized particles were obtained. Deionized water was added to the capsulized particles to prepare a suspension with a solid content of 40%.

Preparation of Toner 125 g of deionized water was added to 125 g (corresponding to 50 g of capsulized particles) of the suspension of capsulized particles thus prepared. The mixture was then stirred at 200 rpm in an agitator equipped with propeller blades (Three-One Motor available from Shinto Kagaku K.K.). 5 g of 1N nitric acid and 4 g of a 10% aqueous solution of serium sulfate were added to the mixture. 0.5 g of ethylene glycol dimethacrylate was then added to the mixture which was then allowed to undergo reaction at a temperature of 15° C. for 3 hours. After completion of the reaction, the reaction product was poured into 1 liter of deionized water, thoroughly stirred, and then subjected to centrifugal separation. After the capsulized particles were separated, the supernatant solution was removed. This procedure was repeated twice to wash the capsulized particles. Thus, capsulized particles comprising ethylene glycol dimethacrylate graft-polymerized on the surface of the shell thereof were obtained.

The capsulized particles were again suspended in deionized water. The suspension was then stirred at 200 rpm in an agitator equipped with propeller blades (Three-One Motor available from Shinto Kagaku K.K.). 0.4 g of potassium persulfate, 0.3 g of chloride of Exemplary Compound (1), 3.0 g of methyl methacrylate, and 0.16 g of sodium hydrogensulfite were sequentially added to the emulsion. The emulsion was then allowed to undergo reaction at a temperature of 25° C. for 3 hours. After completion of the reaction, the reaction product was poured into 2 liters of deionized water. The reaction product was thoroughly stirred, and then subjected to centrifugal separation. After the capsulized particles were separated, the supernatant solution was removed from the system. This procedure was repeated four times to wash the capsulized particles.

2 g of a 5% aqueous solution of an acidic dye (Fast Red A available from Wako Junyaku K.K.) was added to the suspension of capsulized particles thus prepared. The suspension was then stirred at room temperature for 30 minutes to effect the ion exchange reaction. After completion of the reaction, the capsulized particles were washed with 1 liter of deionized water five times to obtain a capsule toner of the present invention. The capsule suspension thus obtained was then poured into a stainless steel tray and dried at a temperature of 60° C. in a dryer for 10 hours.

3 g of the capsule toner thus obtained was then mixed with 100 g of an iron powder carrier covered with a phenolic resin in an environment of a temperature of 20° C. and a humidity of 50% and measured for charging by blow-off process. The result was +18 μC/g. Similarly, the capsule toner was mixed with the iron powder carrier in an environment of a temperature of 28° C. and a humidity of 80% and measured for charging by blow-off process. The result was +16 μC/g. 1 part of a hydrophobic silica (RA200H available from Nihon Aerogel K.K.) was added to and thoroughly mixed with 100 parts of the toner. The toner was then evaluated for image quality in a high temperature and humidity environment of 35° C. and 85% RH. As the copying machine there was used Fuji Xerox 2700 which had been modified for use with capsule toner. As a result, 20,000 sheets of stable copies free of fog were obtained.

COMPARATIVE EXAMPLE 4

A capsule toner was prepared in the same manner as in Example 4 except that an aqueous solution of an acidic dye (Fast Red A available from Wako Junyaku K.K.) was not added. The capsule toner had a chlorine anion left as it was.

3 g of the capsule toner thus obtained was then mixed with 100 g of an iron powder carrier covered with a phenolic resin in an environment of a temperature of 20° C. and a humidity of 50% and measured for charging by blow-off process. The result was +20 μC/g. Similarly, the capsule toner was mixed with the iron powder carrier in an environment of a temperature of 28° C. and a humidity of 80% and measured for charging by blow-off process. The result was +4 μC/g. 1 part of a hydrophobic silica (RA-200H available from Nihon Aerogel K.K.) was added to and thoroughly mixed with 100 parts of the toner. The toner was then evaluated for image quality in a high temperature and humidity environment of 35° C. and 85% RH as in Example 1. As a result, fog occured as early as on the first sheet of copy. The 50th sheet of copy exhibited a drop in image density and hence an image quality with an extremely poor sharpness.

As has been described above, the capsule toner of the present invention comprises a shell made of a substance capable of forming a radical and a polymer containing as monomer component a quaternary ammonium salt-containing vinyl monomer represented by formula (I) attached to the surface thereof and thus allows only one shell constituent to satisfy both the desired mechanical strength and chargeability of the toner. Therefore, the capsule toner of the present invention exhibits a high mechanical strength and an excellent chargeability and thus can provide copied images with an excellent image quality for an extended period of time.

While the invention has been described in detail and with reference to specific embodiments thereof, it will be apparent to one skilled in the art that various changes and modifications can be made therein without departing from the spirit and scope thereof.

What is claimed is:

1. A capsule toner for developing an electrostatic latent image comprising:

a core material;

a shell material covering said core material wherein said shell material comprises a polyurea resin, a polyurethane resin, an epoxyurethane resin, an epoxyurethane resin, a mixture of a polyurea resin and a polyurethane resin or a mixture of an epoxyurea resin and an epoxyurethane resin; and a polymer material chemically bonded to the surface of said shell material comprising as a monomer component a quaternary ammonium salt-containing vinyl monomer represented by formula (I):

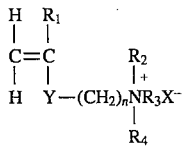

(I)

wherein $R_1$ represents a hydrogen atom or methyl group; $R_2$, $R_3$ and $R_4$ each represents a hydrogen atom, a $C_{1-5}$ alkyl group or a benzyl group; Y represents —$CO_2$— or —CONH—; n represents an integer from 1 to 7; and $X^-$ represents an anion containing a —$COO^-$ group, a —$SO_3^-$ group or a —$SO_4^-$ group in the structure.

2. A capsule toner as claimed in claim 1, wherein said anion in the quaternary ammonium salt-containing vinyl monomer is introduced by ion exchange after polymerization of a corresponding ammonium salt monomer of the formula (I).

3. A capsule toner as claimed in claim 1, wherein said polymer material is chemically bonded to said shell material by graft polymerization.

* * * * *

UNITED STATES PATENT AND TRADEMARK OFFICE

CERTIFICATE OF CORRECTION

PATENT NO. : 5,571,651

DATED : November 05, 1996

INVENTOR(S) : Yoshihiro INABA et al.

It is certified that error appears in the above-indentified patent and that said Letters Patent is hereby corrected as shown below:

Claim 1, column 14, line 7, "epoxyurethane" (first occurrence) should read --epoxyurea--.

Claim 1, column 14, lines 8-9, after "polyurethane resin", insert --,--.

Claim 1, column 14, line 20, in the formula "$Y-(CH_2)nNR_3X^-$" should read --$Y-(CH_2)nNR_3 \cdot X^-$--.

Signed and Sealed this

Fifteenth Day of July, 1997

Bruce Lehman

*Attest:*

BRUCE LEHMAN

*Attesting Officer*

*Commissioner of Patents and Trademarks*